US005165696A

United States Patent [19]

Saha

[11] Patent Number: 5,165,696

[45] Date of Patent: Nov. 24, 1992

[54] VOLLEYBALL TRAINING HARNESS

[76] Inventor: Cynthia D. Saha, 173 Saha Rd., Sealy, Tex. 77474

[21] Appl. No.: 717,690

[22] Filed: Jun. 19, 1991

[51] Int. Cl.[5] ..... A63B 69/00

[52] U.S. Cl. ..... 273/411; 273/DIG. 19

[58] Field of Search ..... 273/411, 414, DIG. 19; 128/878

[56] References Cited

U.S. PATENT DOCUMENTS

| | | | |
|---|---|---|---|
| 794,457 | 7/1905 | Gaiter | 128/878 X |
| 1,699,219 | 1/1929 | Bemish et al. | 273/189 R; |
| 4,030.732 | 6/1977 | Vincent | 273/29 A |
| 4,359,221 | 11/1982 | Taylor | 273/189 R X |
| 4,377,284 | 3/1983 | Okerlin | 273/1.5 A |
| 4,662,366 | 5/1987 | Tari | 128/878 X |
| 4,687,209 | 8/1987 | Carey | 273/414 X |
| 4,890,841 | 1/1990 | Brooks | 273/189 R X |
| 4,892,317 | 1/1990 | Corder, Jr. | 273/189 R X |
| 4,960,280 | 10/1990 | Corder, Jr. | 273/189 R X |

*Primary Examiner*—William H. Grieb
*Attorney, Agent, or Firm*—John R. Kirk, Jr.; Mark A. Oathout; Gordon T. Arnold

[57] ABSTRACT

A volleyball training device having a waistband, wristband and an adjustable connecting strap between the wrist and waist is described. The volleyball player can adjust the connecting strap so that either one or both arms are restricted in movement to the angle and are required for specific volleyball shots.

12 Claims, 2 Drawing Sheets

VOLLEYBALL TRAINING HARNESS

FIELD OF THE INVENTION

The present invention relates to a volleyball training harness for training players in fundamental skills of volleyball. The training harness restrains the player's arm movements so that the relative position of the arms and body are proper for play.

DESCRIPTION OF PRIOR ART

Sports training devices which limit body movements are well known and frequently used in golf, tennis and bowling. No devices exist in prior art, however, for training volleyball players in fundamental skills.

Many devices are known that train the golfer to have a correct golf swing. For example, U.S. Pat. No. 4,892,317 discloses a releasable golf swing training connector which includes a chest strap for encircling the chest of the golfer and an arm strap for encircling the upper arm with a connector strap for connecting the chest and arm straps so that the arm is held close to the body. The following patents also disclose similar golf swing training devices: Brooks, U.S. Pat. No. 4,890,941, Corder, Jr., U.S. Pat. No. 4,960,280 and Bemish, U.S. Pat. No. 1,699,219.

A harness for teaching tennis is disclosed in Vincent, U.S. Pat. No. 4,030,732. Taylor teaches a method for assisting bowlers in maintaining optimum follow-through angles in U.S. Pat. No. 4,359,221 and Okerlin discloses a basketball training device in U.S. Pat. No. 4,377,284.

Each sport requires specific body movements to succeed in that particular sport. Volleyball requires body movements that differ from any other sport and no device exists until this invention that trains a player in those movements. The object of this invention is to provide a restraining harness to force the repetition of proper relative arm and body positions that are used for specific volleyball shots until the player is trained to repeat the correct movements without a restraining device.

SUMMARY OF THE INVENTION

The present invention is a new apparatus for training volleyball players in fundamental skills of play; particularly to perfect the underhand serve and the two handed set-up or bump pass. The apparatus of the invention has an adjustable waistbelt that encircles the waist, an adjustable wristband that encircles the wrist and an adjustable connecting strap that links the wrist to the waist. Prior to practice, the volleyball player can adjust the length of connecting strap or add another strap so that either one or both arms are restricted in movement to the angle required for a specific shot.

The waistbelt is made of a strong, flexible material such as canvas or nylon webbing. It has a means for adjustably fastening about the waist and a means for attaching the connecting strap. Two attachments will be used if both arms are to be limited in movement as is required in the set-up and bump pass skill. Similarly, the wristband is also made of flexible material, has an adjustable means for fastening about the wrist and a means to attach to the connecting strap. Again, two wristbands may be used for specific shots. The waist-to-wrist connecting strap attaches to the waistbelt on one end and attaches to the wristband at the opposite end.

DESCRIPTION OF PREFERRED EMBODIMENT

The volleyball training harness 10 of the present invention is useful for training volleyball players in fundamental skills by restricting the movements of the player's arms to proper positions required to make the basic shots; especially the underhand serve and set-up pass. The volleyball training harness 10 is adaptable so that the movement of one or both arms will be limited to the position appropriate for play.

Figure 1:
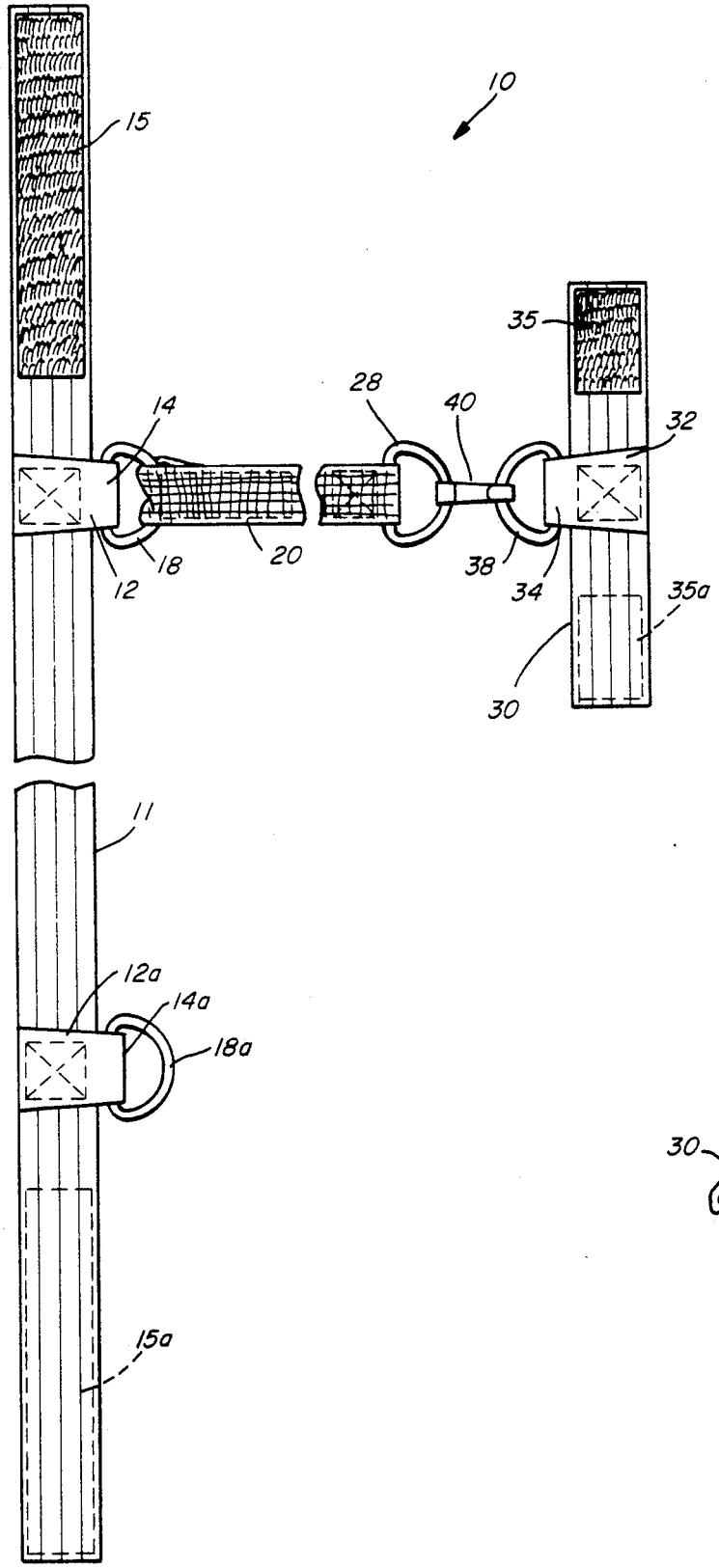
FIG. 1 is a side elevation of the present invention.

Referring now to the drawings, FIG. 1 shows the volleyball harness 10 which includes a waistbelt 11 that adjustably encircles the waist of the player, a wristband 30 that adjustably encircles the wrist, and a connecting strap 20 that adjustably connects the waistbelt 11 to the wristband 30 so that the arm movement of the player wearing the volleyball training harness 10 is limited. By adjusting the connecting strap 20, the player restricts his or her arm movements so that when the arm is extended to the distance allowed by the connecting strap 20, the arm is at the correct angle to the body for the shot being played; whether it is positioning the hand to strike the ball or the follow through after the ball has been hit.

Figure 2:
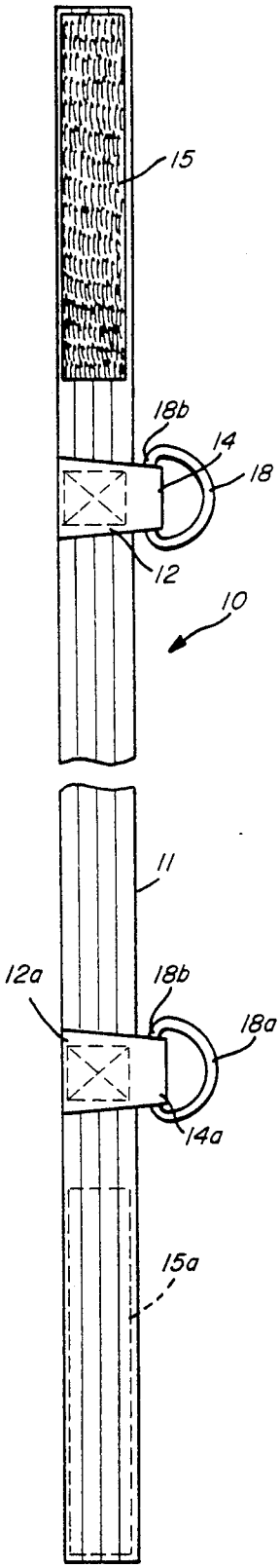
FIG. 2 is a side elevation of the waistbelt of the present invention.
Figure 3:
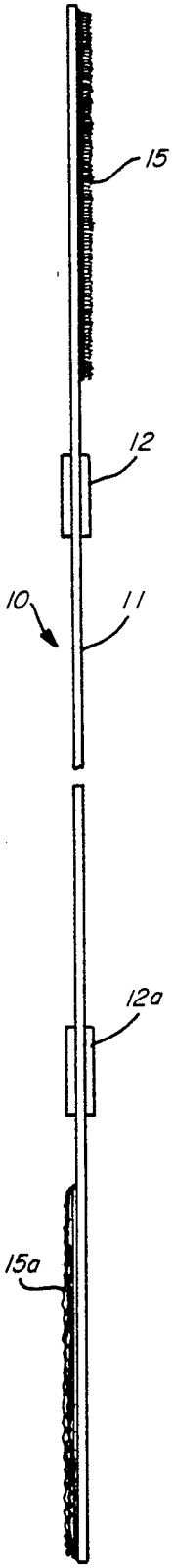
FIG. 3 is a edge view of the waistbelt.

The waistbelt 11 (FIG. 2 and FIG. 3) includes a means for adjustably fastening the waistbelt 11 around the waist of a player. Buckles or snaps can be used but, in the preferred embodiment of the invention, the means for adjustably fastening the waistbelt 11 comprises hook and loop fasteners 15 and 15*a*, commonly known as VELCRO brand fasteners. The more preferred embodiment comprises hook material 15 (FIG. 3) sewn onto one end of the waistbelt 11 and loop material 15*a* sewn onto the opposite end of the waistbelt 11 so that when the hook material 15 mates with the loop material 15*a* the waistbelt 11 is fastened.

The waistbelt 11 further includes a means for attaching the connecting strap 20 to the waistbelt 11. In the preferred embodiment of the volleyball training harness 10, the means for attaching the connecting strap 20 to the waistbelt 11 comprises a strong fabric strip 12, the ends of which are sewn to the waistband 11 so that the midsection of the fabric strip 12 forms a circular loop 14 which extends beyond the edge of the waistbelt 11. A D-ring 18 is secured to the waistband by the circular loop 14 and the connecting strap 20 loops through this D-ring 18 with the flat side 18*b* of the D-ring 18 aligned with the edge of waistband 11. The waistbelt further includes a second means 12*a*, 14*a*, 18*a* for attaching the connecting strap 20. This second connector means 12*a*, 14*a*, 18*a* allows the volleyball training harness to be adapted for either right or left hand players and if desired, further allows two connecting straps and wristbands (not shown in drawings) to be worn so that both arms can be restrained for shots such as the set-up and bump pass. In the preferred embodiment of the volleyball training harness 10, the second means 12*a*, 14*a*, 18*a* for attaching the connecting strap 20 to the waistbelt 11 comprises a second strong fabric strip 12*a*, the ends of which are sewn to the waistband 11 so that the midsection of the fabric strip 12*a* forms a second circular loop 14*a* which extends beyond the waistbelt 11. A second D-ring 18*a* is secured to the waistband by the circular loop 14*a* and the connecting strap 20 loops through this D-ring 18*a*. A second connecting strap and wristband (not shown in drawings) may be attached to this second connector means 12*a*, 14*a*, 18*a*. In the more preferred embodiment of the volleyball training harness 10, the fabric strip 12 is made of leather or canvas.

The wristband 30 includes a means for adjustably fastening the wristband 30 around the wrist of a player. Like the waistband, the preferred means for adjustably fastening the wristband 30 comprises hook and loop fasteners 35 and 35*a* oriented to face each other in a mating or fastening relationship when the wrist is encircled. In the preferred embodiment of the invention, the fasteners 35 and 35*a* comprise hook material 35 sewn onto the interior of one end of the wristband 30 and loop material 35*a* sewn onto the exterior of the opposite end of the wristband 30 so that when the wristband 30 is wrapped around the wrist of the player the hook material 35 mates with the loop material 35*a*.

The wristband 30 further includes a means for attaching the connecting strap 20 to the wristband 30. In the preferred embodiment of the invention the means for attaching the connecting strap 20 to the wristband 30 comprises the same type of strong fabric strip as used on the waistbelt 11. The ends of the wristband fabric strip 32 are sewn to the wristband 30 so that the midsection of the fabric strip 32 forms a circular loop 34 which extends beyond the edge of wristband 30. A D-ring 38 is secured to edge of the wristband 30 by the circular loop 34 in the same manner that D-ring 18 is attached to waistbelt 11. A swival hook 40 attached to one end of the connecting strap 20 hooks to the wristband D-ring 38. In the more preferred embodiment of the invention, the fabric strip 32 is made of leather or canvas. There are several acceptable means or combinations of means for attaching the connecting strip 20 to the waistbelt 11 and wristband 30.

Figure 5:
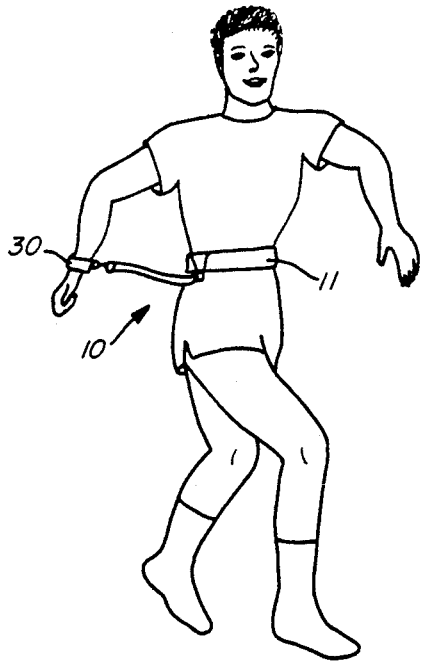
FIG. 5 is a perspective view showing the harness as worn by a player.

The connecting strap 20 connects the waistbelt 11 to the wristband 30 and is adjustable in length. When the connecting strap 20 is adjusted, the arm swing of the player is limited in its reach to a distance equal to the length of the connecting strap 20. In order to train for a specific volleyball shot, the player, prior to play, adjusts the connecting strap 20 to a length that will restrict the arm swing to a distance necessary for that specific shot. A volleyball player wearing the training harness of this invention is shown in FIG. 5.

Figure 4:
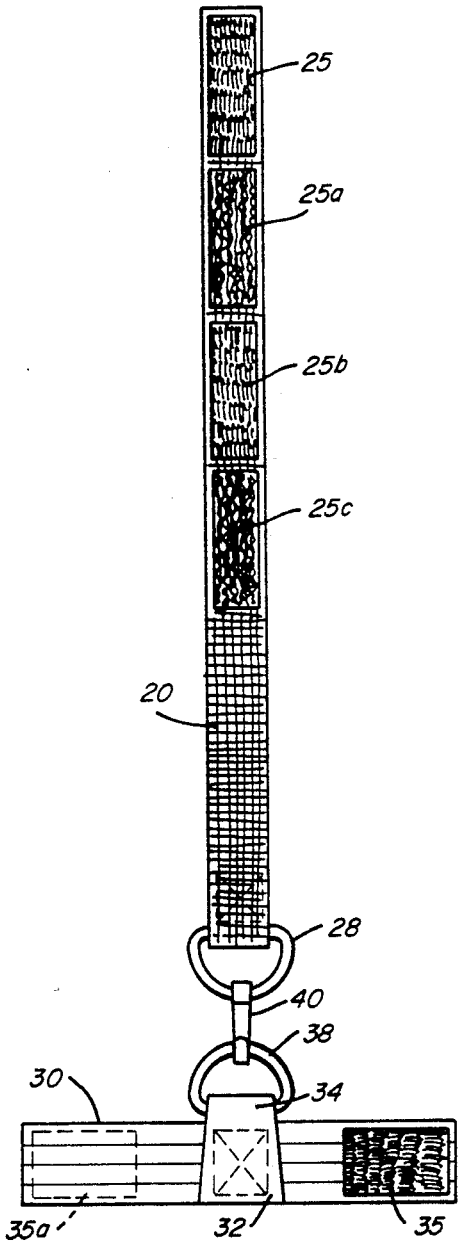
FIG. 4 is a side elevation of a fragmentary portion of the waist-to-wrist connector as it is attached to the wristband.

The connecting strap 20 comprises a means for adjustably attaching one end of the connecting strap 20 to the waistbelt 11 and a means for attaching the other end of the connecting strap 20 to the wristband 30. In the preferred embodiment of the invention, as shown in FIG. 4, the means for adjustably attaching the connecting strap 20 to the waistbelt 11 comprises the first connecting strap 20 having, on its interior side, at least one piece of hook material 25 adjacent to at least one piece of loop material 25*a* so that the connecting strap 20 closes on itself after it is passed through the first D-ring 18 of the waistbelt 11. In a more preferred embodiment of this invention, the first connecting strap 20 may also include a sequential array of additional pieces of hook and loop material in juxtaposition 25*b*, 25*c*. With additional pieces of sequentially arranged hook and loop material 25*b*, 25*c* the player may than adjust the connecting strap 20 to varying lengths. The means for adjustably attaching the connecting strap 20 to the wristband 30 comprises a first connecting strap D-ring 28 linked with a swivel latch-hook 40 that hooks with the D-ring 38 of the first wristband 30. The volleyball training harness can be adapted to have two connecting straps 20 (second connecting strap is not shown) and their accompanying means of attachment 12 and 32 (second means of attachment not shown) so that either right or left arm or both arms can be restricted in their movements. This second connecting strap is attached in the same manner as the first strap. Other ways of attaching and adjusting the length of straps are well known and can be used in the practice of the invention.

Certain volleyball plays such as the set-up and bump shot require both wrists to be together. To train a player for this type of shot, the invention further includes a means for attaching the wristband 30 of the right arm to the wristband of the left arm. However, there are many known two ended clip-on hooks, such as, for example, clip-on hooks which attach a key ring to a belt loop. In the preferred embodiment of the invention, the means for attaching the wristband comprises a spring loaded clip (not in drawings) that hooks with both wristband D-rings 38 with sufficient distance between wrists to execute the shot properly.

The foregoing disclosure and description of the invention are illustrative and explanatory thereof, and various changes in the size, shape, combination and materials as well as the details of the illustrated construction may be made without departing from the scope of the invention. It is understood that the invention is not limited to the specific embodiment described above for purposes of exemplification, but many modifications and changes will be apparent from the description and drawings without departing from the scope of the attached claims.

I claim:

1. A volleyball training harness for creating in the volleyball player a repeating proper swing by the hand and arm in the execution of several volleyball shots comprising:

a waistbelt that encircles and adjustably fastens around the waist of the volleyball player;

a wristband that encircles and adjustably fastens around one wrist of the volleyball player;

a connecting strap that adjustably connects said waistbelt to said wristband so that the movement of the arm of the player wearing said volleyball training harness is limited to a position appropriate for play;

a means for attaching said connecting strap to said waistbelt comprising a fabric strip, the ends of which are attached to said waistbelt to form a loop which secures a D-ring to said waistbelt; and a means for attaching said connecting strap to said wristband.

2. The volleyball training harness of claim 1 wherein said waistbelt is fastened around the waist by hook material sewn onto one end of said waistbelt and loop material sewn onto opposite end of said waistbelt so that hook material mates with loop material when said waistbelt is fastened around waist of player.

3. The volleyball training harness of claim 1 wherein said wristband is fastened around the wrist by wristband hook material sewn onto one end of said wristband and loop material sewn onto opposite end of said wristband so that hook material mates with loop material when said wristband is fastened around wrist of the player.

4. The volleyball training harness of claim 1 wherein said means for adjustably attaching said connecting strap to said waistbelt comprises a sequential array of hook material and loop material in juxtaposition so that said connecting strap closes on itself after it passes through said D-ring of said waistbelt.

5. The volleyball training harness of claim 1 wherein said means for attaching said connecting strap to said wristband comprises:

a connecting strap D-ring; and a swivel latch-hook for hooking to said wristband D-ring.

6. The volleyball training harness of claim 1 further including a second connecting strap, a second means for attaching said second connecting strap to said waistbelt and a second wristband attached to second connecting strap so that movement of both arms of the player can be restrained.

7. A volleyball training harness as recited in claim 6 further including a means for attaching said wristband to said second wristband so that both hands of the volleyball player are in appropriate position for a set-up and bump shot.

8. A volleyball training harness for creating in the volleyball player a repeating proper swing by the hand and arm in the execution of several volleyball shots comprising:

a waistbelt that encircles the waist having means for adjustably fastening around the waist of the player comprising hook material sewn onto one end of said waistbelt and loop material sewn onto opposite end of said waistbelt so that hook material mates with loop material when said waistbelt is fastened around waist of player;

at least one wristband to encircle the wrist having means for adjustably fastening around wrist comprising hook material sewn onto one end of said wristband and loop material sewn onto opposite end of said wristband so that when said hook material mates with loop material said wristband is fastened around wrist of the player;

a connecting strap that adjustably connects to said waistbelt on a proximate end and to said wristband on a distal other so that movement of the arm of the player wearing said volleyball training harness is limited to a position appropriate for play;

means for attaching the proximate end of said connecting strap to said waistbelt comprising a fabric strip, the ends of which are sewn to said waistband to former a circular loop surrounding and attaching a D-ring to said waistbelt;

means for attaching the distal end of said connecting strap to said wristband comprising a fabric strip, the ends of which are sewn to said wristband to form a circular loop attaching a D-ring to said wristband;

means for adjustably attaching the proximate end of said connecting strap to said waistbelt comprising said connecting strap having hook material and loop meterial attached in juxtaposition on one end of said connecting strap so that said connecting strap fastens on itself after it passes through said D-ring of said waistbelt; and means for attaching the distal end of said connecting strap to said wristband comprising a wristband D-ring and swivel latch-hook for coupling with said wristband D-ring.

9. The volleyball training harness of claim 8 which also includes:

a second connecting strap, a second means for attaching said second connecting strap to said waistbelt and a second wristband attached to second connecting strap so that movement of the both arms of the player can be restrained; and a means for attaching said wristband to said second wristband so that both arms are in appropriate position for a set-up and bump shot.

10. A volleyball training harness for creating in the volleyball player a repeating proper swing by the hand and arm in the execution of several volleyball shots comprising:

a waistbelt that encircles and adjustably fastens around the waist of the volleyball player;

a wristband that encircles and adjustably fastens around one wrist of the volleyball player;

a connecting strap that adjustably connects said waistbelt to said wristband so that the arm swing of the player is limited in its reach to a distance equal to the length of the connecting strap;

a means for attaching said connecting strap to said waistbelt; and a means for attaching said connecting strap to said wristband comprising a fabric strip, the ends of which are attached to said wristband to form a loop which secures a D-ring to said wristband.

11. The volleyball training harness of claim 10 including a second connecting strap, a second means for attaching said second connecting strap to said waistbelt and a second wristband attached to second connecting strap so that movement of both arms of the player can be restrained.

12. A volleyball training harness as recited in claim 11 further including a means for attaching said wristband to said second wristband so that both hands of the volleyball player are in appropriate position for a set-up and bump shot.

* * * * *